US005947850A

United States Patent [19]

Gray

[11] Patent Number: 5,947,850

[45] Date of Patent: Sep. 7, 1999

[54] TENNIS BALL RETRIEVER

[76] Inventor: Brian G. Gray, 600 W. Dublin St., Chandler, Ariz. 85224

[21] Appl. No.: 09/103,140

[22] Filed: Jun. 22, 1998

[51] Int. Cl.[6] ..... A63B 49/00

[52] U.S. Cl. ..... 473/517; 294/19.2; 473/553

[58] Field of Search ..... 473/553, 286, 473/463, 517; 224/247; 206/315.9; 294/19.2

[56] References Cited

U.S. PATENT DOCUMENTS

| | | | |
|---|---|---|---|
| 2,116,651 | 5/1938 | Ackerson | 473/286 X |
| 3,401,970 | 9/1968 | Russell | 294/19.2 |
| 3,462,184 | 8/1969 | Russell | 294/19.2 |
| 3,698,720 | 10/1972 | Gudmundsen . | |
| 4,046,413 | 9/1977 | Jeninga | 294/19.2 |
| 4,322,939 | 4/1982 | McDonald | 294/19.2 X |
| 5,333,854 | 8/1994 | Woollard et al. | 473/517 |
| 5,383,661 | 1/1995 | Beck | 473/517 |

FOREIGN PATENT DOCUMENTS

| | | | |
|---|---|---|---|
| 4017483 | 12/1991 | Germany | 473/FOR. 171 |

*Primary Examiner*—Raleigh W. Chiu
*Attorney, Agent, or Firm*—Warren F. B. Lindsley

[57] ABSTRACT

A tennis ball retriever for detachably mounting on the frame of a tennis racket which reduces the stooping and bending usually required to retrieve a tennis ball from the surface of a tennis court. The retriever comprises a pair of tines which are distorted when the racket is forced over the tines of the tennis ball.

4 Claims, 1 Drawing Sheet

TENNIS BALL RETRIEVER

BACKGROUND OF THE INVENTION

This invention relates to a new and improved tennis ball retriever and more particularly to one directed toward the retrofitting of existing tennis rackets with a minimal of effort and without damage to the tennis racket. Tennis players normally bend or stoop to retrieve the tennis ball from the surface of the tennis court.

Retrievers are known which are built into or slipped onto a golf club. Those retrievers generally are built into the golf club during manufacture of the club and usually destroys the balance of the golf club.

At this time, tennis ball retrievers are not known in the marketplace.

DESCRIPTION OF THE PRIOR ART

Various types of ball retrieving devices are known such as those disclosed in U.S. Pat. No. 3,698,720 wherein a golf ball retrieving device is used to retrofit existing golf clubs.

As set forth herein, a new and improved tennis ball retriever is provided which can be slipped onto the existing tennis rackets without permanent damage to the racket and with an expenditure of a minimum time and expense. Once fitted onto the tennis racket, it becomes an integral part of the racket without adversely effecting the utility or appearance of the racket.

SUMMARY OF THE INVENTION

In accordance with the invention claimed, a new and improved novel tennis ball retriever is disclosed which eliminates or greatly reduces the stooping and bending usually required in the retrieval of the tennis ball from the surface of the tennis court.

It is, therefore, one object of this invention to provide a new and improved tennis ball retriever.

Another object of this invention is to provide a new and improved tennis ball retriever that may be secured to the outer surface of the rim of a tennis racket with a minimum of time and effort.

A further object of this invention is to provide a new and improved tennis ball retriever for securing to the outer rim of the tennis racket without effecting the utility or appearance of the racket.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing, in which.

DESCRIPTION OF THE PREFERRED EMBODIMENT

Figure 1:
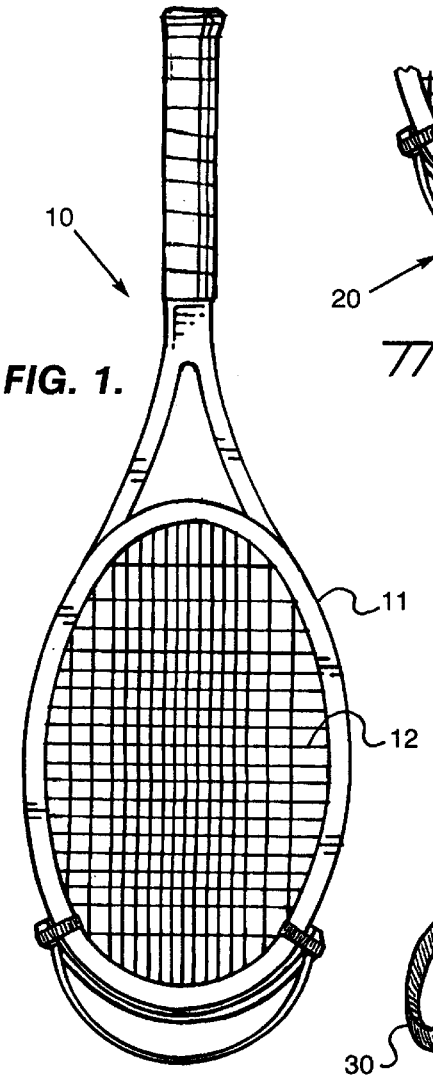
FIG. 1 is a plan view of a tennis racket and embodying the invention.

In reference to the drawing, it will be understood that the drawing merely illustrates one embodiment of the invention and is not intended to limit the invention to the embodiment specifically illustrated.

Tennis is usually played on a court of grass, clay, dirt, concrete, board of composition, the court being divided in half by a net (not shown).

Figure 2:
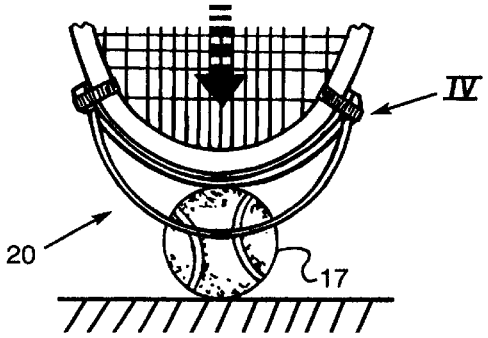
FIG. 2 is a partial view of FIG. 1 showing the tennis ball retriever engaging the tennis ball for retrieval purposes.

A racket 10 the frame 11 of which is made of wood, metal or a composition of other materials, as shown in FIG. 1, is strung with gut, silk or nylon to form a net 12 which weighs from 12 to 16 ounces. The balls 17 shown in FIG. 2 are made of inflated rubber covered with flannel. They weigh slightly in excess of 2 ounces and are a fraction over 2½ inches in diameter.

As shown in FIGS. 1–5, a retriever 20 is mounted on frame 11 at a point opposite to the attachment of the frame to racket 10.

Figure 3:
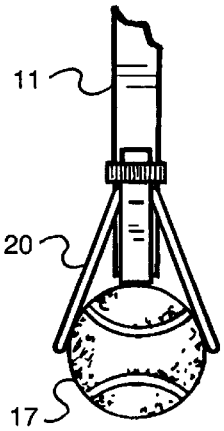
FIG. 3 is a side view of FIG. 2.

The retriever 20, which constitutes the present invention, comprises a tine assembly 21 including at least two resilient tines 22 and 23 joined together at each end by ferrules 24 and 25. A strip of metal or plastic 26 together with the ferrules 24 and 25 form the tines 22 and 23 into an arcuate configuration and are provided for gripping tennis ball 17 around diametric circumference of the ball as shown in FIGS. 2 and 3.

Figure 4:
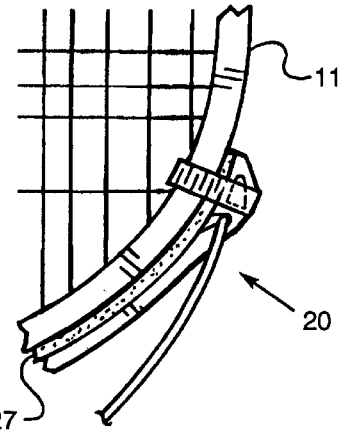
FIG. 4 is an enlarged view of one end of the retriever attached to the tennis racket as shown in FIG. 1.
Figure 5:
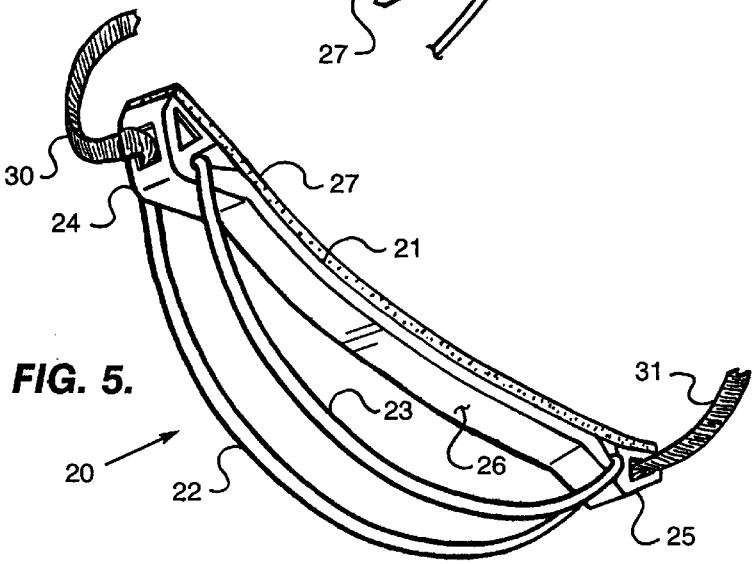
FIG. 5 is an enlarged perspective view of the tennis ball retriever shown in FIGS. 1 and 2.

Strip 26 comprises a flexible member which is provided with a double surface adhesive member 27 which adheres on one surface to a portion of frame 11 and the other adhesive surface to strip 26, as shown in FIGS. 4 and 5.

Ferrules 24 and 25 hold tines 22 and 23 in an arcuate configuration which conforms to the arcuate configuration of frame 11. Each ferrule is attached to frame 11 so as to secure the retriever 20 to the tennis racket 10. One way of attaching retriever 20 to racket 10 comprises the use of Velcro strips 30 and 31. These strips are fastened in and over frame 11 and the wires of net 12. Any other suitable detachable means may be used.

The configuration and resiliency of tines 22 and 23 which may also be called an arcuate bridging member is somewhat critical for proper operation of the retriever. It will be apparent that the tines must normally expand to an arcuate configuration that permits the wires of the tines to slip easily over the tennis ball. The configuration of the tines is generally shown in FIG. 5.

The tines should be made of a material sufficiently resilient to enable the wires of the tines to grip the tennis ball satisfactorily and yet soft enough to permit return of the tines to their original position after the tines have been bent beyond their elastic limit.

It will be recognized that the tennis ball retriever as illustrated and described represents an advance over the prior art in terms of commercial feasibility, technical design, aesthetic appearance, and ease in the operation and convenience of use. These many advantages and features are accomplished through the design and construction of the tennis ball retriever of which the foregoing described and illustrated embodiment are merely illustrative. Many variations of the design and adaptations can be made based upon the foregoing description without departing from the spirit and scope of the invention as defined in the following claims.

What is claimed is:

1. A tennis ball retrieving device for attaching to the frame of a tennis racket comprising in combination:

an elongated resilient arcuate member for attachment to the frame of the tennis racket at a point opposite to the attachment of a handle to the tennis racket, a pair of ferrules one mounted at each end of said member, a pair of arcuate shaped elongated resilient tines with each end thereof attached to a different ferrule, said tines cooperating to receive and hold therebetween a tennis ball, and an elongated connector having one adhesive surface thereof attached to one surface of said member and the other adhesive surface being detachably connected to the frame of the tennis racket at said point.

2. The tennis ball retrieving device set forth in claim 1 in further combination with:

a tie fastened to each ferrule for attaching the device to the frame of said tennis racket.

3. The tennis ball retrieving devices set forth in claim 1 wherein:

said tines each comprise a resilient arcuate shaped wire extending along the length of said member in parallel arrangement with the other of said tines, whereby said tines are distorted to increase the spacing therebetween when a tennis ball is forced therebetween for tennis ball retrieving purposes.

4. The tennis ball retrieving device set forth in claim 1 wherein:

said connector comprises a double surface Velcro connector.

* * * * *